US005316210A

United States Patent [19]

Scullin

[11] Patent Number: 5,316,210

[45] Date of Patent: May 31, 1994

[54] PAPERBOARD STORAGE CONTAINER

[75] Inventor: David J. Scullin, North Olmsted, Ohio

[73] Assignee: Georgia-Pacific Corporation, Atlanta, Ga.

[21] Appl. No.: 61,282

[22] Filed: May 14, 1993

[51] Int. Cl.[5] ..... B65D 5/48; B65D 5/10

[52] U.S. Cl. ..... 229/117.16; 229/120.26; 229/155; 229/172; 229/185

[58] Field of Search ..... 229/117.16, 120.24, 229/120.26, 120.29, 155, 172, 173, 185

[56] References Cited

U.S. PATENT DOCUMENTS

| | | | |
|---|---|---|---|
| Re. 26,557 | 3/1969 | Houston . | |
| 511,078 | 12/1893 | Hibson | 229/185 |
| 636,806 | 11/1899 | Johnstone | 229/185 |
| 1,101,135 | 6/1914 | Lyons | 229/185 |
| 2,319,018 | 4/1943 | Ullman . | |
| 2,675,166 | 4/1954 | Main | 229/172 |
| 2,711,281 | 6/1955 | Argodale | 229/173 |
| 2,757,853 | 8/1956 | Main | 229/185 |
| 2,858,059 | 10/1958 | Kitchell . | |
| 2,913,162 | 11/1959 | Goltz . | |
| 2,961,143 | 11/1960 | Forrer . | |
| 3,202,337 | 8/1965 | Cramer et al. . | |
| 3,301,461 | 1/1967 | Kroeschell . | |
| 3,512,695 | 5/1970 | Anderson | 229/185 |
| 3,645,437 | 2/1972 | Giebel et al. . | |
| 3,667,666 | 6/1972 | Pryor | 229/117.16 |
| 3,670,949 | 6/1972 | Galanes | 229/117.16 |
| 3,727,824 | 4/1973 | Giebel et al. | 229/117.16 |
| 3,730,416 | 5/1973 | Pilz, III . | |
| 4,164,312 | 8/1979 | Harned | 229/120.26 |
| 4,293,091 | 10/1981 | Gerard . | |
| 4,373,660 | 2/1983 | Wytko | 229/173 |
| 4,757,938 | 7/1988 | Collins . | |
| 4,842,189 | 6/1989 | Czosnyka | 229/117.16 |

FOREIGN PATENT DOCUMENTS

| | | | |
|---|---|---|---|
| 2387161 | 11/1978 | France | 229/173 |

*Primary Examiner*—Gary E. Elkins
*Attorney, Agent, or Firm*—Banner, Birch, McKie & Beckett

[57] ABSTRACT

A paperboard container principally for the storage of large, relatively heavy items such as x-ray files, and the like, comprises a box structure having a bottom and upstanding end and side walls formed of multiple layer construction enabling the structure to be extraordinarily strong and rigid and particularly adapted for stacking. The box structure is formed from a pre-cut, pre-scored blank which includes an integrated cover and is self-locking to avoid the need for stapling or gluing. A separately formed partition cooperates with the box structure to divide the interior thereof into separate compartments as well as to enhance the rigidity and stacking strength of the container. The bottom of the container is formed by a continuous, uninterrupted panel so that it can be slid, even when loaded, without endangering its structural integrity.

21 Claims, 6 Drawing Sheets

PAPERBOARD STORAGE CONTAINER

BACKGROUND OF THE INVENTION

The present invention relates to storage containers or box structures formed of paperboard. More particularly, the invention relates to a compartmented container or box structure formed preferably of corrugated paperboard construction and provided with an extraordinarily rigid construction adapted for the stacked storage and transport of relatively heavy loads. Containers of the described type have particular application in the storage of the x-ray file jackets whose day-to-day handling often requires moving x-ray films, and thereby the containers, between separate facilities or between various locations within a single facility.

X-ray file jackets are characteristically relatively large, being about 14.5 inches by 19.0 inches in peripheral dimension. When filled, the carton can weigh upwards of sixty pounds. The size and weight of these items imposes a significant burden, not only on the space requirements for the storage facility, but, as well, on the containers or box structures used to store them, particularly where, for economic reasons, it is desirable to employ low cost, paperboard construction. Compounding this burden is the fact that, in most states, radiographic films and files must be kept for long periods of time. Typically files for adults must be retained for from five to seven years while those for minors must be held until the patient reaches maturity. Thus, since the jackets are normally maintained in chronological order, the older files must be periodically purged to provide space in the storage facility for newer files by moving or transferring them to a separate storage facility that may be located in the basement of the concerned institution or at an offsite location for storage of inactive files. The burden is yet further magnified by the return of a patient whose jacket is in inactive storage whereupon the container bearing the jacket must be retrieved and returned to the hospital or institution compelling more movement of the container.

Prior to the present invention, paperboard containers used to store x-ray jackets were single walled, open ended cartons that were hard to load and unload and that were subject to frequent replacement due to damage imposed by the density and weight of the film files particularly when the containers were moved. Use of single walled containers of reduced strength additionally created a burden on the space and cost of storage facilities since stacking of the containers was prevented, thereby requiring the installation at the storage facility of expensive steel racking or shelving, or the like, to accommodate vertical storage of the containers.

It is to the amelioration of these problems, therefore, to which the present invention is directed.

SUMMARY OF THE INVENTION

Accordingly, there is provided by the present invention a paperboard container having a bottom and rectangularly disposed walls including oppositely spaced side and end walls upstanding from said bottom, the container comprising a pair of side wall panels foldably connected in alternating disposition between three end wall panels to place one end wall panel during assembly in overlapping registry with another end wall panel; a bottom panel foldably connected to the bottom edge of the sidewall panel adjacent the one end wall panel and carrying a foldably connected spacer panel for interposition between the registering end wall panels when the bottom panel is folded to close the lower edges of the side and end wall panels when rectangularly disposed; a locking tab foldably connected to the bottom edge of the one end wall panel; and means forming a slot for reception of the locking tab on the fold line between the bottom panel and the spacer panel for locking the container in an assembled condition.

It is therefore a principal object of the invention to provide an inexpensive, extraordinarily rigid container construction erected from precut, prescored blanks of paperboard, without need for taping, stapling or gluing.

It is another object of the invention to provide a paperboard container construction characterized by sufficient strength and rigidity to enable stacking and frequent handling without loss of structural integrity.

It is still another object of the invention to provide a container construction in which the walls and bottom thereof are formed of a plurality panels in order to improve the strength, rigidity and durability of the construction.

A further object of the invention is to provide a self-locking container construction having a fortified bottom that is continuous and uninterrupted across the full extent of its surface in order to facilitate movement of the container by sliding, or otherwise.

It is yet another object of the invention to provide a container construction of the concerned type which is readily adaptable to compartmentation and that includes an integrated hinged cover which protects the contents from dust, dirt and physical injury.

Other objects of the present invention reside in the simplicity of construction and ease of assembly of the container, as well as its adaptability for the concerned purpose of use.

For a better understanding of the invention, its operating advantages and the specific objectives obtained by its use, reference should be made to the accompanying drawings and description which relate to a preferred embodiment thereof.

DETAILED DESCRIPTION OF THE PREFERRED EMBODIMENTS

Figure 1:
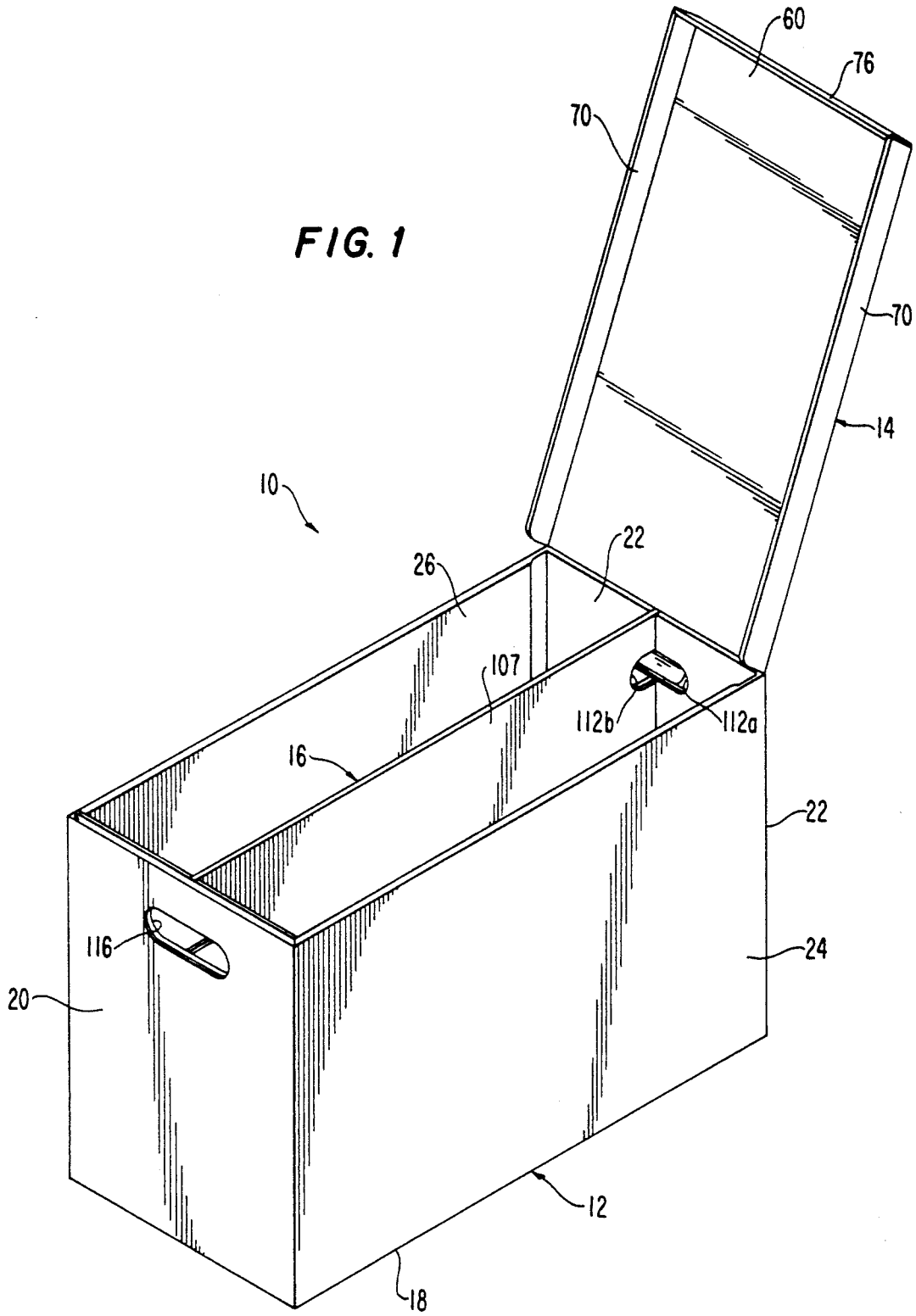
FIG. 1 is a perspective view of a fully erected container according to the present invention.

Referring now to the drawings, numeral 10 designates the complete container construction according to a preferred form of the present invention. It comprises a generally rectangular box structure 12 having an integrally formed hinged cover 14 and a separately formed partition portion 16. All of the members are preferably constructed of corrugated paperboard in which the weight of the linerboard and the size of fluting are selected with regard to the use to which the container will be put.

Figure 3:
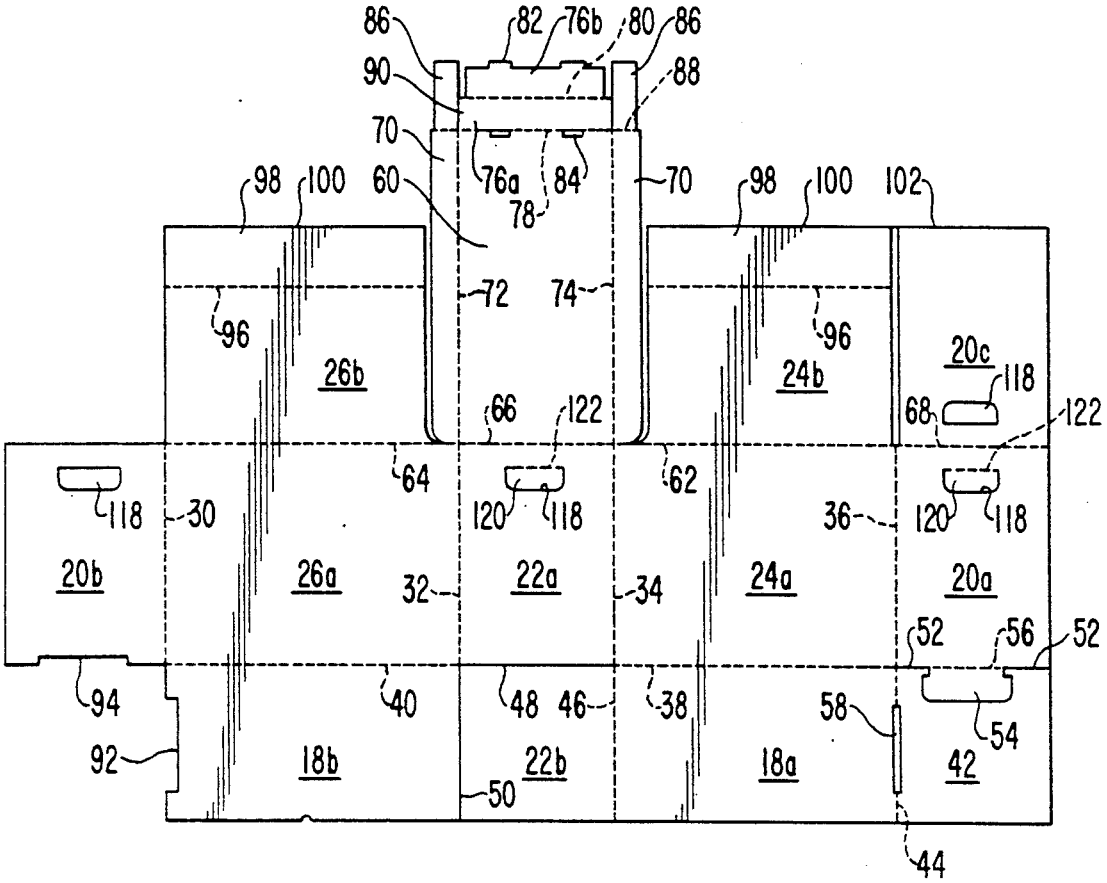
FIG. 3 is a plan view of the box blank.

The box structure 12 includes a bottom 18 and upstanding walls 20 to 26 that are all of multiple panel construction. The box structure 12 is formed from the blank, indicated generally in FIG. 3 by numeral 28, which is scored and slit to define a series of foldably interconnected panels as hereinafter described. The bottom 18 comprises a double panel construction formed from the overlapping of a bottom panel and a bottom liner panel, indicated as 18*a* and 18*b*, respectively. The upstanding walls comprise a pair of opposed, relatively narrow end walls, designated front end wall 20 and rear end wall 22 and a pair of opposed right and left side walls, designated 24 and 26 respectively. As shown, the side walls 24 and 26 have a greater length than the end walls 20 and 22.

The blank 28 is divided into three series of panels, the central of which comprises alternately disposed end and sidewall panels including three correspondingly dimensioned end wall panels, designated front end wall panel 20*a*, rear end wall panel 22*a* and front end wall liner 20*b*. It also comprises intermediate right side wall panel 24*a* and left side wall panel 26*a*. The panels of the central series are mutually separated by parallel fold lines 30 through 36 which extend in the direction of the depth of the box 12.

Depending from the central series of panels are the bottom panel 18*a* and bottom liner panel 18*b* that depend from the right and left side wall panels 24*a* and 26*a*, respectively. As shown, the bottom and bottom liner panels 18*a* and 18*b* are coextensive with the side wall panels 24*a* and 26*a* and separated therefrom by fold lines 38 and 40 which extend in the direction of the length dimension of the box. Bottom panel 18*a* carries panel extensions at its opposite ends which include front end wall spacer panel 42 disposed at the outermost end of the panel series and separated from the adjacent end of the bottom panel by fold line 44. The other end of bottom panel 18*a* carries rear end wall liner panel 22*b* which is separated therefrom by fold line 46. The illustrated lines 48 and 50, the former of which separates rear end wall liner panel 22*b* from the rear end wall panel 22*a*, and the latter of which separates panel 22*b* from bottom liner panel 18*b* are lines defining severed edges, the rear end wall liner panel being foldably connected only to bottom panel 18*a*.

Front end wall spacer panel 42 occupies the outermost position in the lower series of panels and is separated from front end wall panel 20*a* by a cut line 52. As shown, the spacer panel 42 contains within its boundary sides, a locking tab 54, as defined by cut line 52, that is integral with, and depends from, the lower edge of the front end wall panel 20*a*. Locking tab 54 is joined to panel 20*a* by fold line 56 which is of limited length along the cut line 52. As described in more detail hereinafter, fold line 44 between spacer panel 42 and bottom panel 18*a* contains an intermediately positioned slot 58 for reception of the locking tab 54.

The blank 28, on the other side of the central series of panels, contains right and left side wall liner panels 24*b* and 26*b*, respectively, as well as cover panel 60 and front end wall cover panel 20*c*, which are alternately disposed with respect to the side wall liner panels. Fold lines 62 and 64 serve to foldably interconnect the left and right side wall panels 24*a* and 26*a* to their respective liner panels 24*b* and 26*b*. Fold line 66, on the other hand, forms a hinge connection between the cover panel 60 and rear end wall panel 22*a* while fold line 68 foldably interconnects the front end wall and front end wall cover panels 20*a* and 20*c*, respectively.

The cover panel 60, whose transverse dimension corresponds to the fold line 66, has a longitudinal dimension rendering the panel operative to close the top of the box structure 12 when assembled. A depending flange arrangement about three sides of the cover panel 60 serves to overlap the box opening thereby to protect the interior of the box against the ingress of dust and dirt, as well as to frictionally retain the cover in a closed condition. As shown, cover side flanges 70 are foldably connected to the cover panel 60 along parallel fold lines 72 and 74. A cover front flange 76*a* is foldably connected along fold line 78 to the free end of the cover panel 60. A front flange liner 76*b* foldably connects with flange 76*a* via a wide score line 80 to enable tabs 82 formed at spaced locations along the outside edge of the liner to be lockingly received in cooperating slots 84 provided along the fold line 80.

Completing the construction of the cover are corner flaps 86 which are connected via fold lines 88 to the respective side flanges 70. Cut lines 90 separate the corner flaps 86 from the cover front flange 76*a* whereby, upon assembly, the flaps are interposed between the front flange 76*a* and front flange lines 76*b* when these elements are folded to dispose the tabs 82 in locked disposition in the slots 84.

To erect the box structure 12, the bottom liner panel 18*b* is first folded inwardly about fold line 40. Thereafter, bottom panel 18*a* carrying rear end wall liner panel 22*b* and front end wall spacer panel 42 is folded inwardly about fold line 38. Next, the blank 28 is folded about each of fold lines 30 through 36 to place the panels forming the end and side walls 20 and 22, respectively, in a rectangular array with front end wall liner panel 20*b* in substantial overlying registry with front end wall panel 20*a*. In rectangularly disposing the walls, bottom liner panel 18*b* is placed in overlying registration with bottom panel 18*a*. Coincident therewith, the rear end wall liner panel 22*b* is folded about fold line 46 and the front end wall spacer panel 42 is similarly folded about fold line 44. Thus, the rear end wall liner panel 22*b* and the front end wall spacer panel 42 are placed against the associated rear end wall panel 22*a* and front end wall panel 20*a*, respectively. This action not only captures the bottom and bottom liner panels 18*a* and 18*b*, it also places the locking tab 54 closely adjacent the slot 58 whereupon by folding the locking tab about fold line 56, it can be placed in locking disposition within the slot. In order to avoid any obstruction of the cooperative engagement of the locking tab 54 within slot 58, formed recesses 92 and 94, which sized to accommodate the locking tab, may be provided in bottom liner panel 18*b* and front end wall liner panel 20*b*.

After the panels forming the bottom and the walls of the box structure 12 have been locked into a rectangular array, the right and left side wall liner panels 24*b* and 26*b* are folded inwardly against the inner surfaces of the side wall panels 24*a* and 26*a*, respectively. In view of the fact that the depth dimension of the liner panels corresponds substantially with that of the side wall panels and that the transverse dimension of the top opening of the box structure 12 is significantly less than such depth dimension, the liner panels may be conveniently provided with score lines 96 forming bendable flaps 98 at the free ends of the liner panels. The score lines 96 should be placed a distance measured from the respective fold lines 62 and 64 that is less than the transverse width of the box structure opening whereupon the flaps 98 can bend to permit the panels to be folded into place and thereafter the flaps returned to a substantial coplanar disposition with respect to the remainder of the liner panels. In this way, the end edges 100 of the flaps are placed in tight frictional engagement in the bottom of the box structure, represented by the upper surface of the bottom liner panel 18*b*, thereby establishing a stiffening reinforcement of the side walls. The formation of the box structure 12 is completed by folding the front end wall cover panel 20*c* about fold line 68 to place its bottom edge 102 in frictional engagement with the upper surface of the bottom liner panel 18*b*.

It will be appreciated that the box structure 12 of the container 10, as thus far described, has a bottom and upstanding walls that are each formed of multiple panels, thereby providing these elements with enhanced strength and rigidity. The bottom 18 and the side walls 24 and 26 each consist of a pair of overlapping panels giving each section of the box structure a double-wall construction. The rear end wall 22 of the structure is similarly provided with enhanced strength by being formed of a pair of panels 22*a* and 22*b*. Front end wall 20, which is subject to magnified loads during stacking, is provided with an enhanced strength satisfactory for this purpose by the array of four sandwiched panels including three end wall panels 20*a*, 20*b*, 20*c* and the spacer panel 42 in its structure.

Advantageously, the bottom and upstanding walls of the box structure 12 are securely locked in place without need for the use of glue, staples or tape by the interlocking engagement of the locking tab 54 with the cooperating slot 58. Moreover, location of the locking tab 54 and slot 58 along the intersection of the bottom and an end wall enables the bottom surface of the box as defined by the lower surface of panel 18*a* to be continuous and uninterrupted whereby sliding movement can be imparted to the box structure when it is loaded without danger of damaging the box as a result of catching the tab or other irregularity on a projecting irregularity on the surface across which the container is slid.

Figure 4:
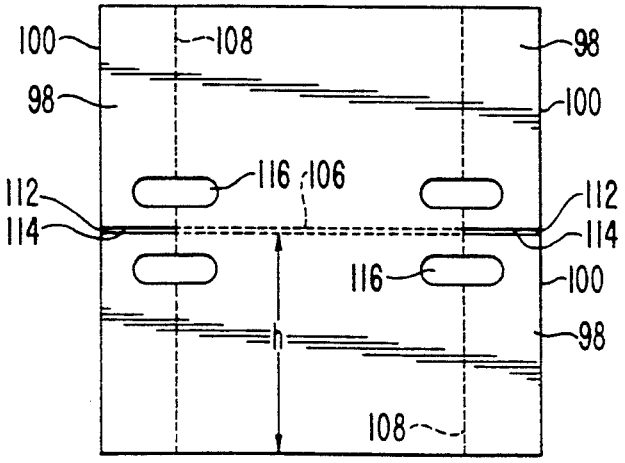
FIG. 4 is a plan view of the partition structure blank.
Figure 5:
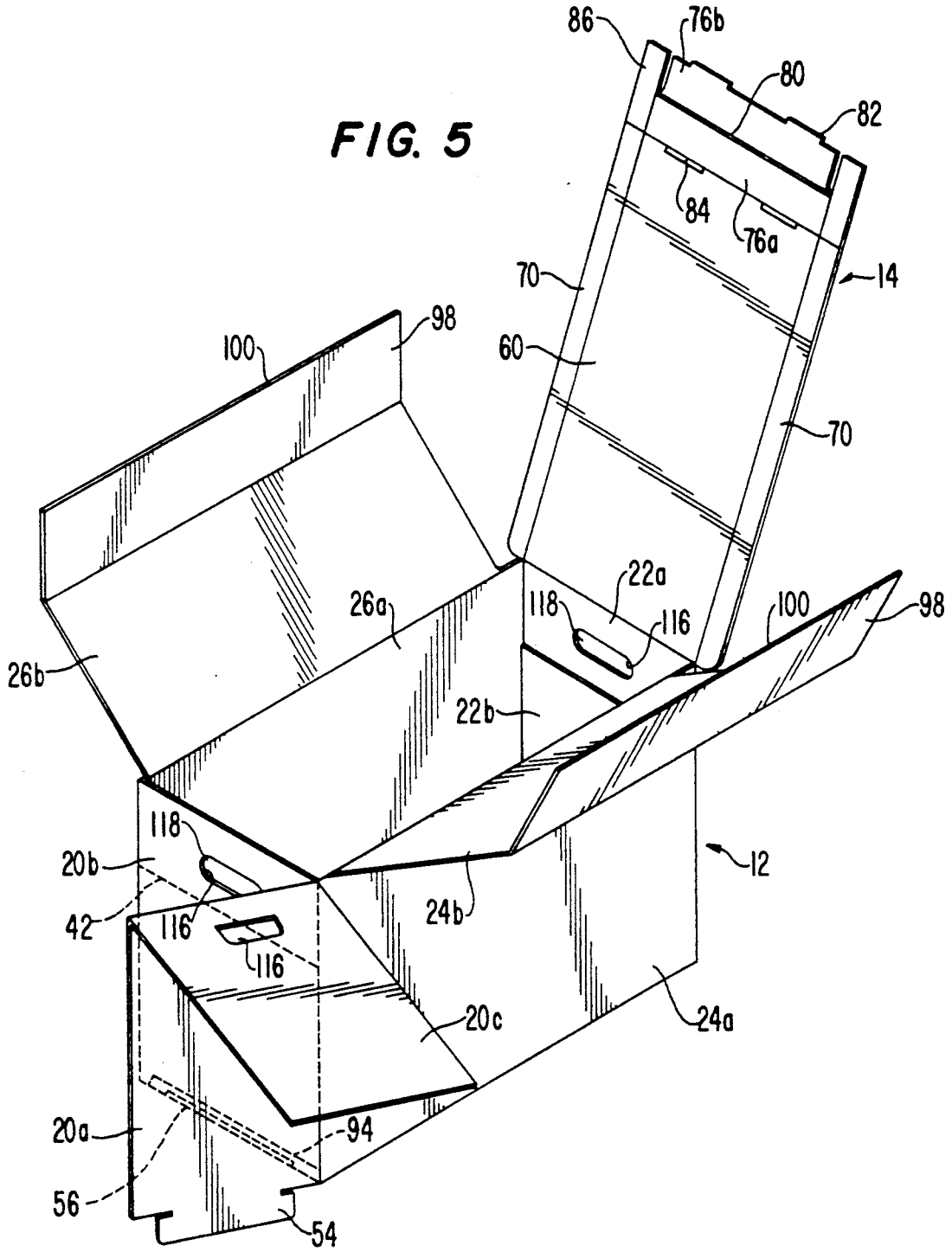
FIG. 5 is a view of the box of the container at an intermediate stage of its erection.
Figure 6:
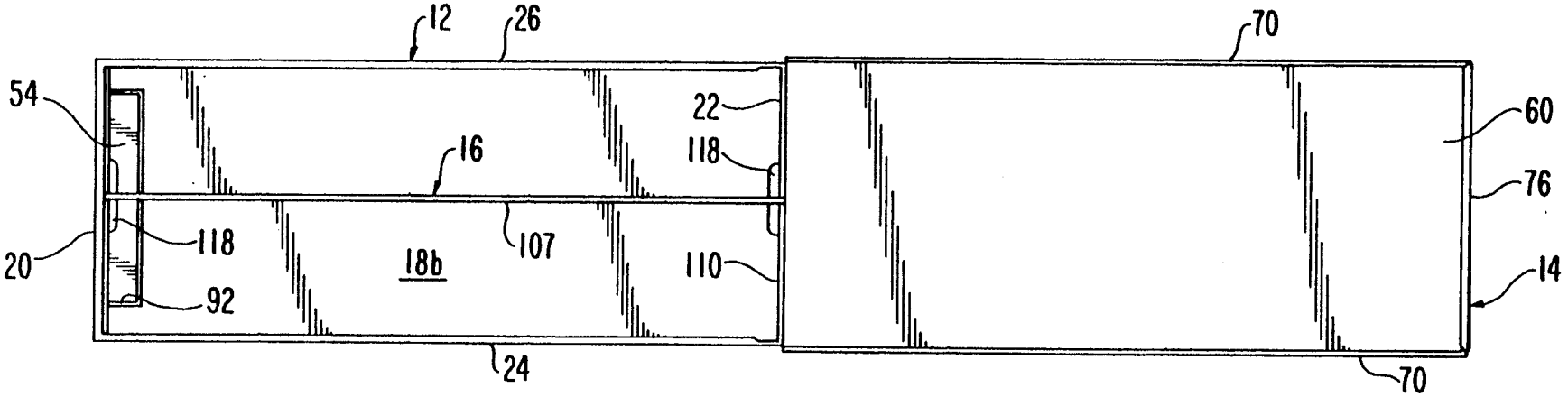
FIG. 6 is a top plan view of the container of FIG. 1 with the cover in an open condition.
Figure 7:
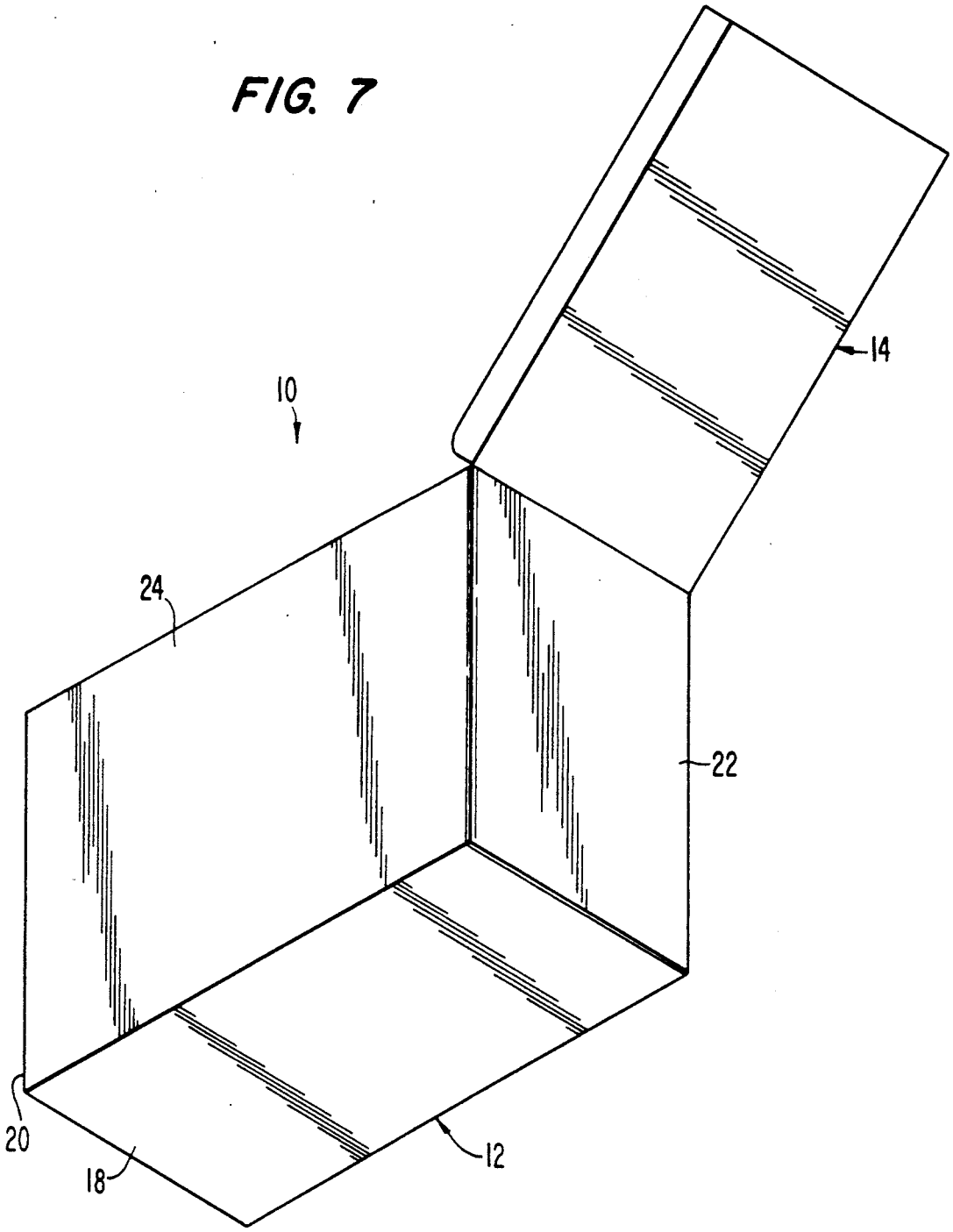
FIG. 7 is a bottom perspective view of the container of FIG. 1 with the cover open.

According to a further aspect of the invention, the strength and rigidity of the box structure 12, particularly in the vertical direction, as is desirable in order to enable the containers 10 to accommodate greater stacking loads, is enhanced by the addition of a partition element 16 having a particular structural configuration. The partition element 16 is formed from a blank 104 of corrugated paperboard that is separate from the blank 28. As shown in FIG. 4, the blank 104 has a substantially rectangular peripheral shape with a medial, longitudinal score line 106 and a pair of transverse score lines 108 positioned at predetermined locations adjacent opposite ends of the blank. Accordingly, the medial score line 106, which is either a double score line or one of substantial width, is disposed such that the blank, when folded therealong, provides a double walled structure indicated as 107 whose height h corresponds substantially to the effective depth of the interior of the box structure 12. Score lines 108, on the other hand, permit the end portions 110 of the blank 104 on opposite sides of the medial score line 106 to be folded in opposite directions from the structure 107 thereby forming end flanges to provide the partition element 16, when erected, with a substantial H-shape.

Assisting in the formation of the H-shape of the partition element 16 is the provision of slots 112 that align with the score line 106 on the outboard sides of the respective transverse score lines 108. As shown, the slots are preferably formed with side edges 114 that are mutually spaced a distance corresponding substantially to the width of score line 106. This is to insure that the resultant end portions 110 are substantially the same length, and no greater, than the effective height h of the double-walled partition structure 107.

Figure 2:
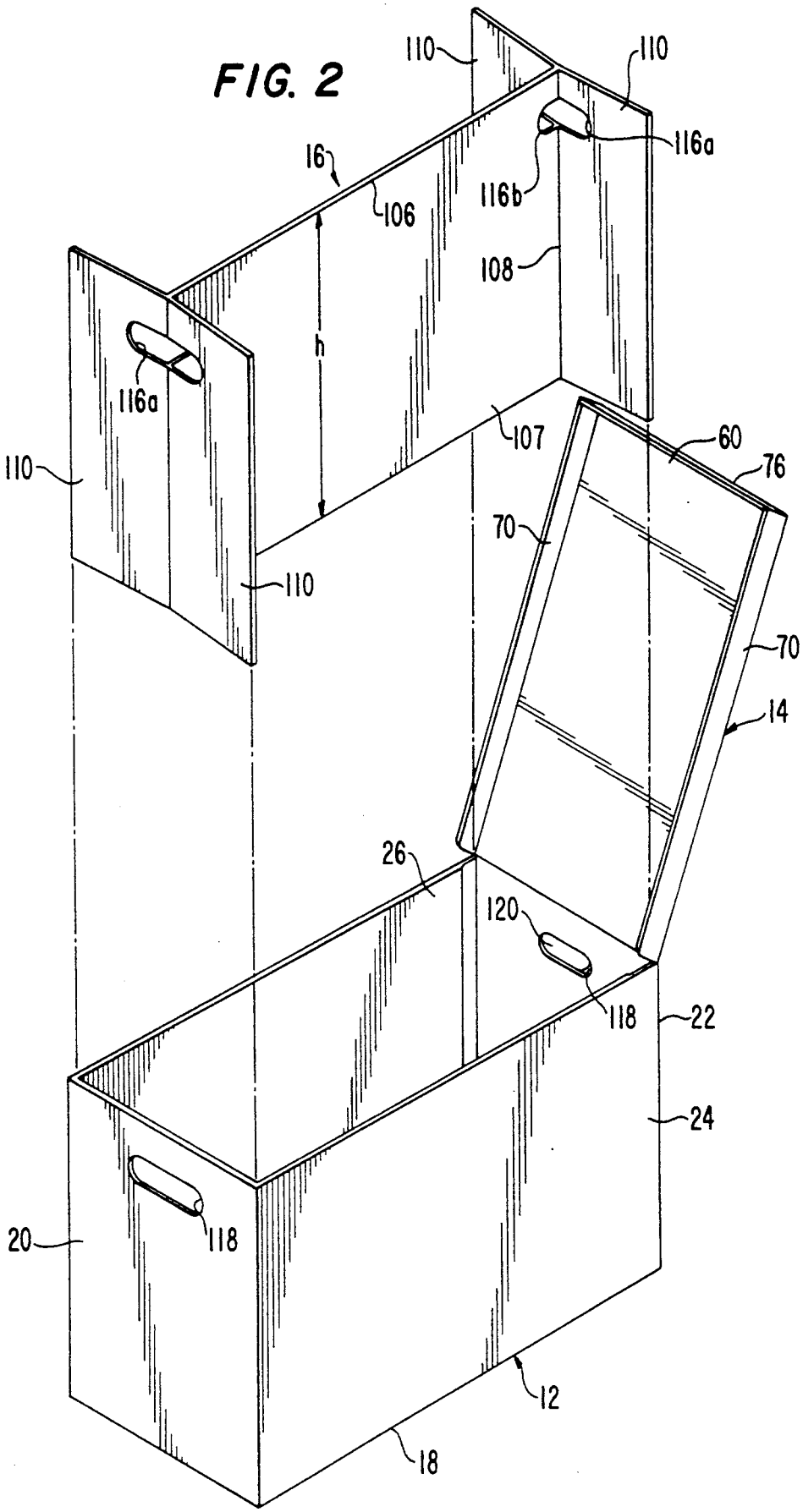
FIG. 2 is an exploded perspective view of the box and the partition structure which comprise the container of FIG. 1.

In order to anchor the partition element 16 within the box structure 12, the blank 104 is provided with elongated openings 116 which, as shown in FIG. 4, extend across the transverse score lines 108 and are equidistantly spaced on opposite sides of the longitudinal axis of the blank as defined by the medial score line 106 and slots 112. The disposition of the openings 116 is such that, upon folding the blank 104 in order to erect the partition element 16, transverse openings, indicated as 116*a* in FIG. 2, are created on the flanges formed by the folded end portions 110, which openings penetrate the double-walled partition structure 107, as indicated at 116*b*. Openings 116*a* are so disposed in the flange structures as to register with hand hold openings 118 provided in the front and rear end wall panels 20*a* and 22*a* and in the front end wall liner and cover panels 20*b* and 20*c*, respectively. Residual tabs 120 that remain connected to the front and rear end wall panels by fold lines 122 are inwardly foldable whereby they extend either over or through the adjacent panels to connectingly engage the compound-shaped openings 116*a* and 116*b* in the partition element 16 to secure it in place within the box structure 12.

It will be appreciated, therefore, that with installation of the partition element 16 in the assembled box structure 12 there results a paperboard panel-constructed container 10 that has a reinforced bottom 18, reinforced end and side walls 20 and 22 and a partition element 16 that serves to compartmentalize the box structure and to provide reinforcement along the medial longitudinal axis thereof. The bottom 18 contains two panels, indicated as 18*a* and 18*b*, and opposed side walls 24 and 26 each contain two panels, indicated as 24*a* and 24*b* and 26*a* and 26*b*, respectively, while the space intermediate the side walls is provided with vertical support by means of the double-walled structure 107 defined by partition element 16. Reinforcement of the container end walls 20 and 22 is provided, at the rear end wall which carries the hinged cover 14, by end wall panel 22*a* and also by the flange structure formed by the folded end portions 110 of the partition element 16 whose height dimension corresponds substantially with the effective height of the end wall panel 22*a*. At the front end wall 20, which is required to bear the most severe loadings during movement and stacking of the containers 10, the panel 20*a* obtains the required reinforcement from the liner and cover panels 20*b* and 20*c*, respectively, and additionally from the flange structure formed by the folded end portions 110 at the other end of the partition element 16.

From the foregoing, therefore, it is apparent that the invention described herein provides a novel, low cost container construction having particular utility in the storage and movement of relatively heavy loads, such as, for example, file jackets for x-ray film. The box portion of the construction, including its hinged cover, is formed from a single blank that is easily erectable without the need for gluing, taping or stapling into a walled structure of multiple thickness to provide it with extraordinary strength that enables the containers, when stored, to be stacked directly one upon the other.

Moreover, the unique location of the locking tab at the interface between intersecting surfaces leaves the panel forming the container bottom free of irregularities capable of catching on surface irregularities and thus eliminates a potential cause of damage, particularly during periods of container movement.

It will be understood that various changes in the details, materials and arrangements of parts which have been herein described and illustrated in order to explain the nature of the invention, may be made by those skilled in the art within the principle and scope of the invention as expressed in the appended claims.

I claim:

1. A container formed from a paperboard blank, said container having a bottom and rectangularly disposed walls including oppositely spaced side and end walls upstanding from said bottom, said container comprising:

a pair of side wall panels foldably connected in alternating disposition between three end wall panels placing one of said end wall panels in overlapping registry with another of said end wall panels with said sidewall panels and said end wall panels positioned in mutual rectangular disposition;

a bottom panel foldably connected to a bottom edge of a sidewall panel adjacent said one end wall panel and carrying a foldably connected spacer panel which is interposed between said registering end wall panels when said bottom panel is angularly offset with respect to said sidewall panel and closes lower ends of said rectangularly disposed side and end walls;

a locking tab foldably connected to a bottom edge of said one end wall panel; and means forming a slot on a fold line between said bottom panel and said spacer panel, said slot receiving said locking tab for locking said container in an assembled condition.

2. A container according to claim 1 including a cover panel foldably connected to an upper edge of one of said end wall panels forming a pivotable closure.

3. A container according to claim 2 in which said cover panel is connected to an end wall panel that is opposite from said registering end wall panels.

4. A container according to claim 1 including liner panels foldably connected to said side wall panels and said bottom panel, said liner panels overlapping said bottom panel and said side and end wall panels, except said registering end wall panels.

5. A container according to claim 4 in which said side walls are longer than said end walls and in which said side liner panels contain fold lines permitting flexure thereof during assembly of said container.

6. A container according to claim 1 including a partition extending across said bottom panel between a pair of said oppositely spaced walls.

7. A container according to claim 6 in which said end and side walls and said partition are substantially equal in height.

8. A container according to claim 7 in which said partition extends between a pair of said oppositely spaced end walls.

9. A container according to claim 7 in which said partition comprises an H-shaped member disposed within said container, said partition having flanges defined at its opposite ends disposed in tightly adjacent relation with respect to said container opposed end walls.

10. A container according to claim 9 in which said H-shaped member comprises a paperboard panel folded along a medial fold line and having said flanges at its ends formed by end portions flexibly offset in opposite directions from the planes of said folded panel.

11. A container according to claim 10 in which said container end wall panels contain displaceable pre-cut tabs forming hand hole openings, said partition extending between opposed end walls containing said end wall panels and having openings in said flanges aligned with said hand hole openings lockingly receiving said pre-cut tabs.

12. A container formed from a paperboard blank, said container having a bottom and rectangularly disposed walls including oppositely spaced side and end walls upstanding from said bottom, said bottom and said rectangularly disposed walls being formed of multiple layers, comprising:

a pair of side wall panels foldably connected in alternating disposition between three end wall panels placing an endmost of said end wall panels in overlapping registry with the other endmost of said end wall panels;

a bottom panel foldably connected to bottom edge of said side wall panel adjacent said other endmost end wall panel and carrying at one end a foldably connected spacer panel and at its other end a foldably connected liner panel which are interposed between said registering end wall panels and line the opposed end wall panel respectively when said bottom panel is angularly offset with respect to said side wall panel and closes the bottom of said container;

a bottom liner panel foldably connected to the bottom of said other side wall panel and overlying said bottom panel for lining said bottom panel;

each of said side wall panels having an upper edge foldably connecting a side wall liner panel which lines the interior of the respective of said side wall panels;

a locking tab foldably connected to a bottom edge of said one endmost end wall panel; and means forming a slot on a fold line between said bottom panel and said spacer panel, said slot receiving said locking tab for locking said container in an assembled condition.

13. A container according to claim 12 including a cover panel foldably connected to the upper edge of one of said end wall panels forming a pivotable closure.

14. A container according to claim 13 in which said cover panel is connected to said end wall panel that is opposite from said registering panels when said container is assembled.

15. A container according to claim 12 in which said side walls are longer than said end walls and in which said side liner panels contain fold lines permitting flexure thereof during assembly of said container.

16. A container according to claim 12 including a generally H-shaped member forming a partition disposed within said container with flanges at opposite ends of said partition being disposed in tightly adjacent relation to each of pair of oppositely spaced container walls.

17. A container according to claim 16 in which said H-shaped member comprises a paperboard panel folded along a medial fold line and having said flanges at opposite ends of said partition formed by end portions flexibly offset in opposite directions from the planes of said folded panel.

18. A container according to claim 17 in which said end wall panels contain displaceable pre-cut tabs forming hand hole openings, said partition extending between a pair of oppositely spaced end walls containing said end wall panels and each of said flanges containing openings for locking engagement by said pre-cut tabs.

19. A container formed from a paperboard blank, said container having a bottom and rectangularly disposed walls including oppositely spaced side and end walls upstanding from said bottom, said bottom and said rectangularly disposed walls being formed of multiple layers, comprising:

a pair of side wall panels foldably connected in alternating disposition between three end wall panels placing one endmost end wall panel in overlapping registry with the other endmost end wall panel;

a bottom panel foldably connected to a bottom edge of a sidewall panel adjacent said other endmost end wall panel and carrying at one end a foldably connected spacer panel and at its other end a foldably connected liner panel, said spacer panel being interposed between said registering end wall panels and said liner panel registering with said one endmost endwall panel to line the opposed end wall panels, respectively, with said bottom panel folded to close the bottom of said container;

a bottom liner panel foldably connected to the bottom of other side wall panel to line said bottom panel;

each of said side wall panels having an upper edge foldably connecting a side wall liner panel which lines the interior of the respective of said side wall panels;

a cover panel foldably connected to the upper edge of one of said end wall panels forming a pivotable closure;

a locking tab foldably connected to a bottom edge of said one endmost end wall panel;

means forming a slot on a fold line between said bottom panel and said spacer panel, said slot receiving said locking tab for locking said container in an assembled condition; and a generally H-shaped member forming a partition disposed within said container, said member comprising a paperboard panel folded along a medial fold line and having its parallel ends formed by portions offset in opposite directions from the planes of said folded panel forming flexible flanges effective to bias said partition tightly between said container end walls.

20. A container according to claim 19 in which said end wall panels contain displaceable pre-cut tabs forming hand hole openings; said offset portions of said partition containing openings for reception of said pre-cut tabs for securing said partition within said container.

21. A container according to claim 20 in which said end and side walls and said partition are substantially equal in height.

* * * * *